US007748801B2

(12) United States Patent
Prenter

(10) Patent No.: US 7,748,801 B2
(45) Date of Patent: Jul. 6, 2010

(54) TELESCOPIC GUIDE FOR DRAWERS AND SIMILAR FURNITURE COMPONENTS EXTENDABLE FROM A BODY OF FURNITURE

(75) Inventor: Christian Prenter, Altach (AT)

(73) Assignee: Alfit AG, Goetzis (AT)

( * ) Notice: Subject to any disclaimer, the term of this patent is extended or adjusted under 35 U.S.C. 154(b) by 484 days.

(21) Appl. No.: 11/685,844

(22) Filed: Mar. 14, 2007

(65) Prior Publication Data

US 2008/0224583 A1 Sep. 18, 2008

(51) Int. Cl.
*A47B 88/00* (2006.01)

(52) U.S. Cl. ..... 312/334.16

(58) Field of Classification Search ..... 312/334.6, 312/334.7–334.18, 334.27, 334.29, 334.31–334.34, 312/334.36–334.39; 384/18, 19
See application file for complete search history.

(56) References Cited

U.S. PATENT DOCUMENTS

| | | | | |
|---|---|---|---|---|
| 3,160,280 | A * | 12/1964 | Burch | 211/89.01 |
| 4,737,039 | A * | 4/1988 | Sekerich | 384/18 |
| 4,752,143 | A * | 6/1988 | Lautenschlager, Jr. | 384/19 |
| 5,536,083 | A * | 7/1996 | Brustle et al. | 312/334.6 |
| 5,882,100 | A * | 3/1999 | Rock | 312/334.34 |
| 6,682,160 | B2 * | 1/2004 | Kung | 312/334.6 |
| 7,156,478 | B2 * | 1/2007 | Harn et al. | 312/334.6 |
| 7,296,863 | B2 * | 11/2007 | Lam et al. | 312/334.6 |

(Continued)

FOREIGN PATENT DOCUMENTS

| | | |
|---|---|---|
| DE | 36 41 325 A1 | 6/1988 |

(Continued)

*Primary Examiner*—Janet M Wilkens
*Assistant Examiner*—Dan Rohrhoff
(74) *Attorney, Agent, or Firm*—Norris McLaughlin & Marcus, PA

(57) ABSTRACT

A fully extendable telescopic drawer guide (10; 10') for furniture components, such as drawers, work surfaces and the like, that can be extended from the body of an item of furniture, with a guide rail (12) facing the body, a running rail (14) associated with the extendable furniture component, and an intermediate rail (16) arranged between these two rails, wherein rolling elements are provided which are supported in cages (24; 26) and which transfer the load of the extendable furniture component by way of rolling surfaces disposed on the rails, and wherein at least one rotatably supported supporting roller (30) for the running rail is provided on the front end of the intermediate rail. The intermediate rail (16) is implemented as a profile rail which encompasses the region of the guide rail (12) provided with the rolling surfaces and which has on the bottom side an elongated opening for insertion of the support region of the guide rail to be secured to the body wall of an associated item of furniture. The intermediate rail (16) further includes inner rolling surfaces for the rolling elements that face the rolling surfaces of the guide rail (12). The running rail is also formed as a profile rail which also has on the bottom side an elongated opening and encompasses the intermediate rail. Two supporting rollers (30) are supported on the front end of the intermediate rail on axles that protrude horizontally from the opposing lateral profile legs of the intermediate rail (16) perpendicular to the pull-out direction, with the peripheral surfaces of the supporting rollers being supported on rolling surfaces disposed on the interior of the running rail (14) and extending in the pull-out direction.

4 Claims, 3 Drawing Sheets

U.S. PATENT DOCUMENTS

| | | | | |
|---|---|---|---|---|
| 7,320,508 | B2 * | 1/2008 | Booker et al. | 312/334.6 |
| 2004/0212284 | A1 * | 10/2004 | Fitz | 312/334.13 |

FOREIGN PATENT DOCUMENTS

| | | | |
|---|---|---|---|
| DE | 42 41 832 | A1 | 6/1993 |
| EP | 0 694 270 | A1 | 1/1996 |
| EP | 0 834 270 | A2 | 4/1998 |
| EP | 0 834 270 | B1 | 4/1998 |

* cited by examiner 18
18
18
5
5
30
32
20
14
26
10'
12
16
28
6
4
4
24
44
44

TELESCOPIC GUIDE FOR DRAWERS AND SIMILAR FURNITURE COMPONENTS EXTENDABLE FROM A BODY OF FURNITURE

BACKGROUND OF THE INVENTION

The invention relates to a fully extendable telescopic drawer guide for furniture components, such as drawers, work surfaces and the like, that can be extended from the body of an item of furniture, with a guide rail facing the body, a running rail associated with the extendable furniture component, and an intermediate rail arranged between these two rails, wherein rolling elements are provided which are supported in cages and which transfer the load of the extendable furniture component by way of rolling surfaces provided on the rails, and wherein at least one rotatably supported supporting roller for the running rail is provided on the front end of the intermediate rail.

Drawers and other extendable furniture components can be supported by fully extendable telescopic guides for easy movement in the body of a cabinet, so that the drawer can be fully pulled out of the body in the open position, making the content of the drawer readily accessible. This design is more complex in comparison to telescopic guides embodied as a simple telescopic rail with only a single guide rail and a single running rail, because the intermediate rail must be supported at two places, namely on the guide rail as well as on the running rail. Fully extendable telescopic guides are inherently less rigid than single guides and require a more complex design to prevent elastic deformation of the rail which would cause the faceplate of an open drawer to be displaced downward, in particular when the drawer is heavy. The individual rails for telescopic guides to be used with heavy drawers must therefore not only have an overall greater load carrying capacity, but typically also have an additional supporting roller on the front end of the intermediate rail, which employs cage-supported rolling elements to decrease the load on the mobile support in the critical open position of the drawer. Such fully extendable telescopic guides are disclosed, for example, in EP 0 834 270 B1.

SUMMARY OF THE INVENTION

It is therefore an object of the invention to improve the load-bearing capacity of telescopic guides of the aforedescribed type without increasing the design complexity or without impeding ease of movement.

Based on a telescopic guide of the aforedescribed type, the object is solved by the invention in that the intermediate rail is implemented as a profile rail which encompasses the region of the guide rail with the rolling surfaces and which has on the bottom side an elongated opening for insertion of the support region of the guide rail to be secured to the body wall of an associated item of furniture, with the intermediate rail further including inner rolling surfaces for the rolling elements that face the rolling surfaces of the guide rail, in that the running rail is also implemented as a profile rail which also has on the bottom side an elongated opening and which encompasses the intermediate rail, and in that two supporting rollers are supported on the front end of the intermediate rail on axles that protrude horizontally from the opposing lateral profile legs of the intermediate rail perpendicular to the pull-out direction, with the peripheral surfaces of the supporting rollers being supported on rolling surfaces arranged on the inside of the running rail and extending in the pull-out direction. Both the intermediate rail and the running rail are configured as a hollow profile which is only open on the bottom side and otherwise substantially closed, with the running rail completely encompassing the intermediate rail. This makes the design of the individual rails according to the invention very compact and stable and also symmetric with respect to a vertical center plane. The weight of the drawer can then be transferred proportionally and symmetrically with respect to the aforementioned symmetry plane. As a particular advantage, the proportional load of the drawer weight can be transferred symmetrically from the running rail via the two supporting rollers, which are arranged symmetrical to the aforementioned vertical longitudinal center plane, when the drawer is open.

According to a first embodiment of the invention, the axles which rotatably support the supporting rollers are arranged on the opposite profile legs of the intermediate rail, preferably non-releasably.

A configuration may be envisioned wherein the axles are welded to the outer sides of the lateral profile legs of the intermediate rail, or wherein the axles are connected by a rivet connection through a permanent material deformation of a protuberance of the axles, when the axles are inserted in a corresponding opening in the profile legs.

Alternatively, the axles which rotatably support the supporting rollers may be provided on a separate axle support that can be attached to the front end of the intermediate rail.

Advantageously, the axle support may have the form of a retaining member which fittingly encompasses the outer sides of the intermediate rail and which is open on the bottom side. In another advantageous embodiment, the retaining member may have a cross-sectional shape which resembles a "U" rotated by 180° and is open on the bottom side, wherein the downward pointing lateral U-shaped legs of the retaining member can be brought into suitable contact with the lateral profile legs of the intermediate rail.

In another embodiment adapted for simple and quick installation of the axle support, latchingly engageable projections and openings may be provided in the regions of the U-shaped legs of the retaining member and of the lateral profile legs that face one another in the intended installation position of the axle support on the intermediate rail.

Preferably, the projections are provided on the inner sides of the U-shaped leg of the retaining member and project into the openings which are formed as punched-out sections in the profile legs.

To facilitate installation of the retaining member through attachment on the intermediate rail, the projections are provided with corresponding beveled stop sections.

The web section of the retaining member connecting the U-shaped legs is advantageously formed so as to be elastically deformable in a center region extending in the pull-out direction, so that the U-shaped legs can elastically expand during installation on the intermediate rail and springily retract for latching engagement when the projections are aligned with the openings.

Advantageously, the axle support is formed as an integral plastic part produced by injection molding. Alternatively, the axle support may also be formed as a diecast metal part.

Two exemplary embodiments of the invention will be described in more detail in the following description to be read in conjunction with the drawing, which shows in

DETAILED DESCRIPTION

Figure 1:
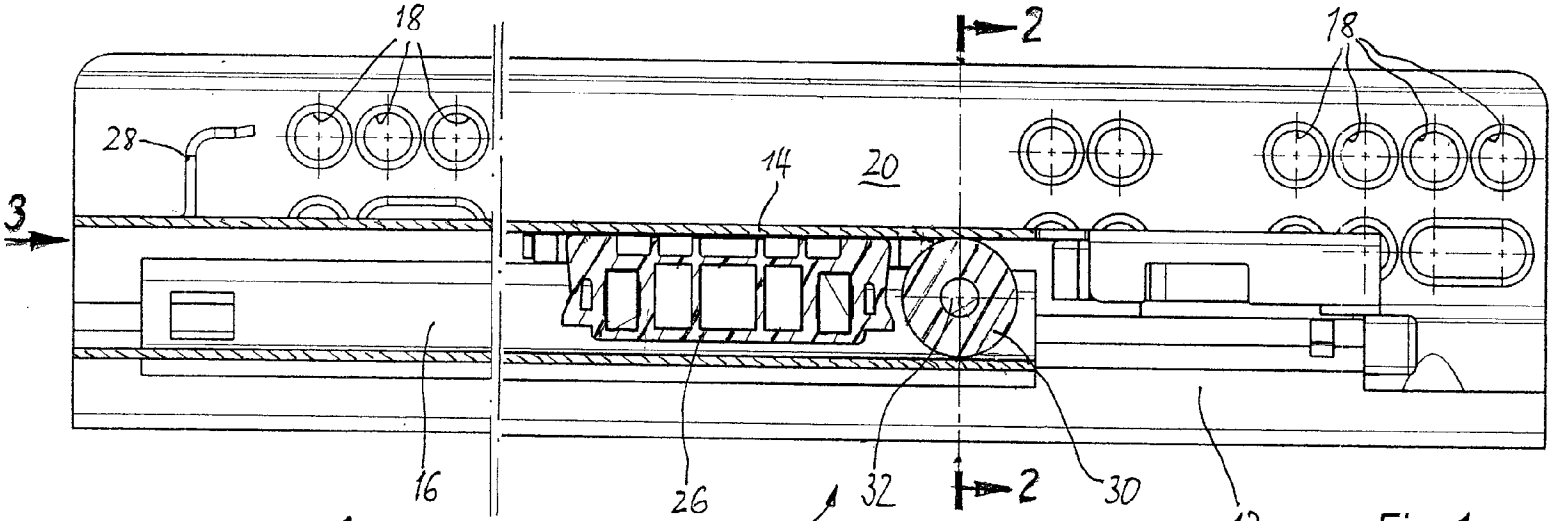
FIG. 1 a cross-sectional view of a first exemplary embodiment of a telescopic drawer guide of the invention taken along the direction of the arrows 1-1 in FIG. 3.
Figure 2:
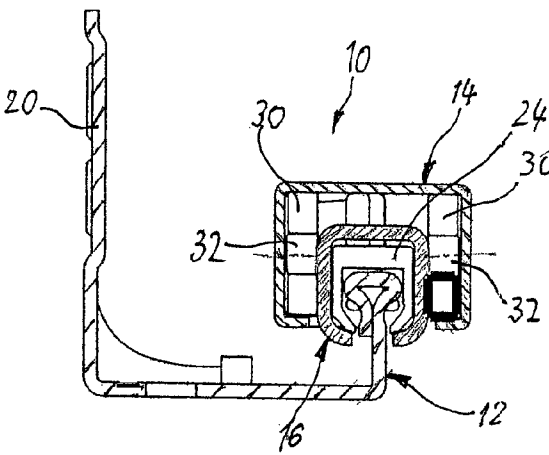
FIG. 2 a cross-sectional view, as viewed in the direction of the arrows 2-2 in FIG. 1.
Figure 3:
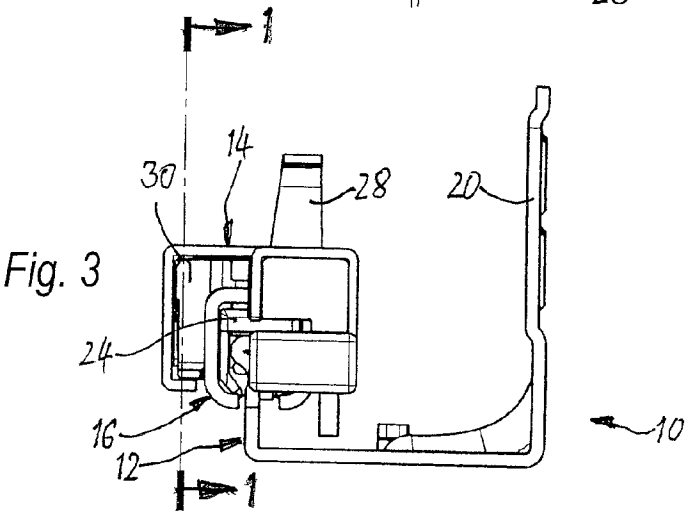
FIG. 3 a view of the telescopic guide, as viewed in the direction of arrow 3 in FIG. 1.

FIGS. 1 to 3 illustrate a first exemplary embodiment of a telescopic guide having the overall reference symbol 10, which in the illustrated example is implemented as a fully extendable drawer. The telescopic guide is composed of three rails which are guided relative to each other for longitudinal movement, namely a guide rail 12 which can be attached to the inside surface of the side wall of the body of an item of an furniture, a running rail 14 which can be attached to an extendable furniture component, i.e., typically the drawer, in the region of the bottom side of the drawer sidewall or in an adjacent region of the drawer bottom, and an intermediate rail 16 arranged between the body and the running rail.

In the illustrated example, the guide rail 12 is a profile formed of sheet metal with a U-shaped cross-section, wherein one of the U-shaped legs forms a mounting plate 20 provided with bores 18 which can be screwed to the inside of the body sidewall of an associated cabinet. The region of the free end of the second U-shaped leg is shaped so as to include on the inside of the intermediate rail 16 running surfaces for rolling elements shaped as rollers (not shown), which are described in more detail below. The running surfaces run parallel to and are spaced from the mounting plate 20. One set of rolling elements move on an upper rolling surface and two rows of additional rolling elements move on rolling surfaces which are spaced apart horizontally and offset upwardly with respect to the upper rolling surface. The rolling elements are held in a suitably shaped plastic cage 24 to maintain their mutual arrangement and orientation. The bottom side of the intermediate rail 16 is formed as a hollow profile with a through-slot, with the U-shaped leg of the guide rail 12 with the running surfaces adapted to extend through the slot. The cross-section of the hollow profile is shaped so as to fittingly encompass the rolling elements which are rotatably held in the cage 24, meaning that the inner surface of the intermediate rail 16 also functions as running surfaces.

The running rail 14 is a profile rail having a similar shape as the intermediate rail 16, but larger cross-sectional dimensions, so that the intermediate rail 16 can be arranged inside of the running rail 14. Rolling surfaces for rolling elements (not shown) in the form of rollers that are rotatably supported in a cage 26 are again formed in the unobstructed space between the horizontal web surfaces and the opposing lateral leg surfaces of the profile.

The running rail 14 is attached to a corresponding drawer below the drawer bottom in a conventional manner, for which purpose an attachment hook 28 is provided in the rearward region of the running rails. The free end of the attachment hook 28 has a bent end section which is pushed into a bore disposed on the rear wall of the drawer, when the drawer is mounted on the running rail.

On the front end of the intermediate rail 16, two lateral spaced-apart supporting rollers 30 are supported on journals 32 for rotation about a horizontal axle extending transverse to the pull-out direction. The journals 32 protrude from the outside surfaces of the vertical profile legs of the intermediate rail 16 and are non-releasably connected with the profile legs of the intermediate rail, for example by welding or riveting.

The diameter of the supporting rollers 30 is selected that they fit snugly between the inner surfaces of the upper horizontal profile web and the respective inner surfaces of the elongated bent sections that are bent inward at a right angle from the lower end of the profile legs of the running rail 14. In the position of the telescopic guide 10 where the drawer is fully extended, the peripheral surfaces of the supporting rollers 30, in addition to the support by the rolling elements provided in cage 26, then support the running rails and counteract a possible downward deformation of the entire telescopic guide caused by the weight of the drawer and its content. This additional support in conjunction with the meshing arrangement and the special cross-sectional design of the intermediate rail and of the running rail allows for a very compact, low profile construction of the telescopic guide 10 with a large load-carrying capacity.

Figures 4, 5, 6:
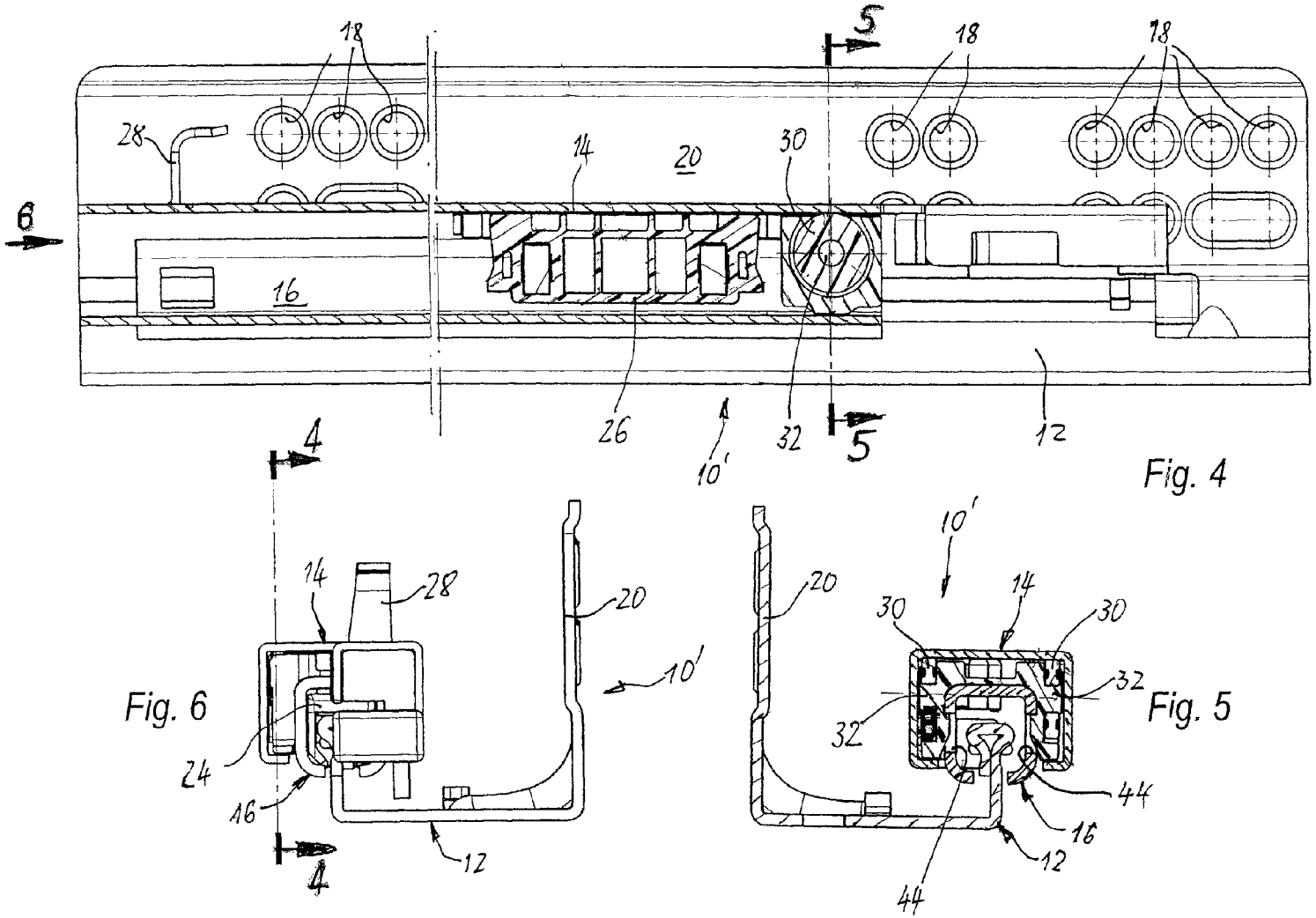
FIG. 4 a cross-sectional view of a second exemplary embodiment of a telescopic drawer guide of the invention taken along the direction of the arrows 4-4 in FIG. 6.
FIG. 5 a cross-sectional view, as viewed in the direction of the arrows 5-5 in FIG. 4.
FIG. 6 a view of the telescopic guide, as viewed in the direction of arrow 6 in FIG. 4.
Figure 7:
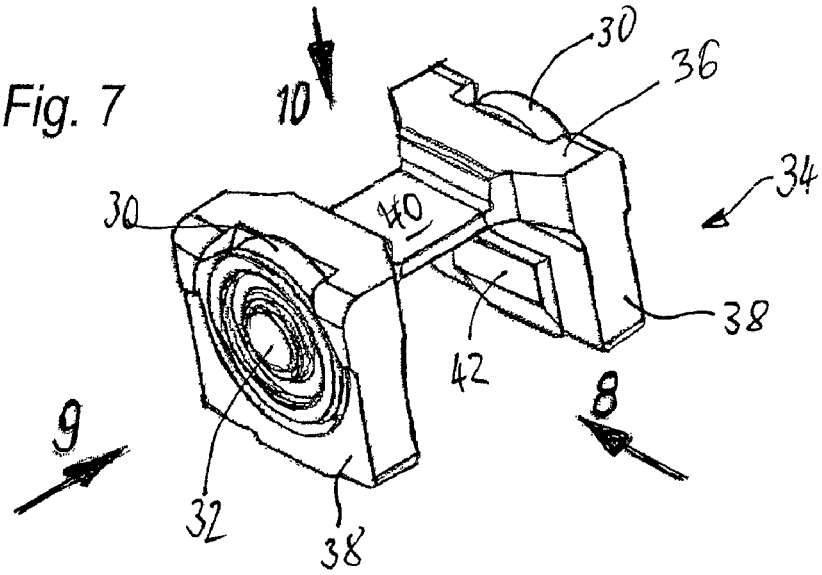
FIG. 7 an isometric view of an axle support which in the second exemplary embodiment can be releasably attached to a front end of the intermediate rail, as viewed in the pull-out direction, and which rotatably supports two supporting rollers for the running rail.
Figure 8:
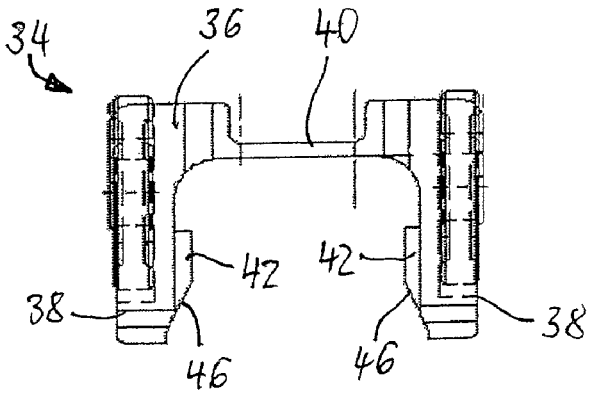
FIG. 8 a view of the axle support, as viewed in the direction of arrow 8 in FIG. 7.
Figure 9:
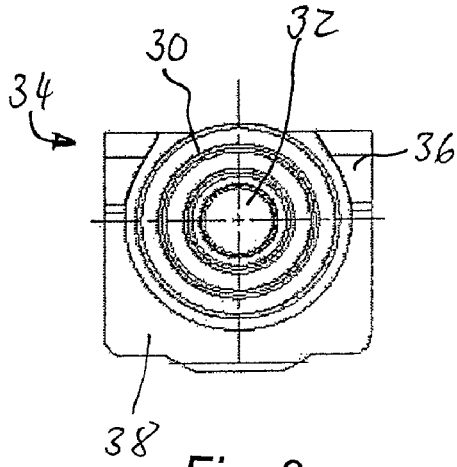
FIG. 9 a view of the axle support, as viewed in the direction of arrow 9 in FIG. 7.
Figure 10:
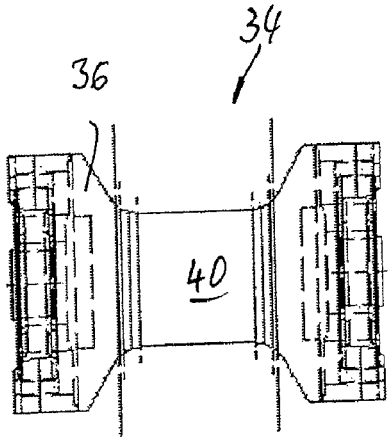
FIG. 10 a view of the axle support, as viewed in the direction of arrow 10 in FIG. 7.

The basic construction and operation of the modified telescopic guide 10' depicted in FIGS. 4 to 6 is substantially identical to that of the telescopic guide 10 described above with reference to FIGS. 1 to 3. Accordingly, only specific differences will be described more closely, whereby reference is made to the above description to avoid unnecessary repetition. Like components in the embodiments depicted in the drawings are indicated with identical reference symbols.

The essential difference between the telescopic guide 10 and the telescopic guide 10' is the arrangement of the journals 32 for the supporting rollers 30 on the intermediate rail 16. The journals for the supporting rollers are in this case part of an axle support 34 which is shown separately in FIGS. 7 to 10. In the depicted example, the axle support 34 is an integral injection molded part made of an extremely rigid thermoplastic material, on which the journals are integrally molded.

The axle support 34 has the form of a retaining member 36 which fittingly encompasses the outer surfaces of the profile legs of the intermediate rail 16 and which is open on the bottom side. Stated differently, the axle support 34 has the cross-sectional shape of a "U" rotated by 180°, i.e., is open on the bottom side. The relatively massive spaced-apart lateral legs 38 are connected by a web 40 which is at least along certain sections thinner than the legs 38. The web 40 is elastically deformable with respect to a vertical longitudinal center plane, whereby the opening between the free ends of the legs 38 can be expanded through elastic deformation of the web 40. Integrally formed projections 42 protrude from the inner surfaces of the legs 38 of the retaining member facing the profile legs of the intermediate rail, as viewed along the intended mounting position on the intermediate rail 16. In the intended mounting position of the retaining member 36 on the intermediate rail 16, the projections 42 engage with corresponding punched-out openings 44 in the profile legs of the intermediate rail, thereby preventing the retaining member 36 from being pulled out and/or from being lifted off the intermediate rail 16 in the vertical direction.

The retaining member 36 can be mounted on the intermediate rail 16 by placing the opening formed between the legs 38 of the retaining member on the top side of the intermediate rail 16 and applying pressure to the top side of the retaining member. This pressure elastically bends the web 40 and therefore urges the free ends of the legs 38 apart. The retaining member can then be moved to the intended mounting position on the intermediate rail 16, where the projections 42 latchingly engage in the punched-out openings 44. The beveled stop sections 46 disposed on the projections 42 facilitate attachment of the retaining member to the intermediate rail.

Because the upper bounds of the protections 42 facing the beveled stop sections 46 protrude from the inner surface of the legs 38 essentially at a right angle, it becomes impossible to unintentionally disengage the retaining member even when applying an upward force to the running rail in the open position.

It will be understood that modifications and improvements of the aforedescribed exemplary embodiments, relating, for example, to the manner in which the journal 32 is arranged either directly on the intermediate rail 16 or on the axle support 34, can be realized without departing from the scope of the present invention. The axle support 34 including the journal 32 need not be manufactured as an integral part, but can instead also be produced by making only the retaining member 36 of plastic by injection molding or—alternatively—of metal by die-casting, in which case the journals 32 for the supporting rollers are produced separately and mounted on the retaining member 36.

The invention claimed is:

1. A fully extendable telescopic drawer guide for furniture components that can be extended from a body of an item of furniture, the fully extendable telescopic drawer guide comprising a guide rail adapted to face the body, a running rail associated with the furniture component, and an intermediate rail arranged between the guide rail and the running rail, wherein rolling elements are provided which are supported in cages and are adapted to transfer a load of the furniture component by way of rolling surfaces disposed on the guide rail, the running rail and the intermediate rail, wherein at least one rotatably supported supporting roller for the running rail is provided on a front end of the intermediate rail, wherein the intermediate rail is implemented as a profile rail which encompasses a region of the guide rail having the rolling surfaces and which has, on a bottom side, an elongated opening for insertion of a support region of the guide rail to be secured to a body wall of the item of furniture, wherein the intermediate rail comprises inner rolling surfaces for the rolling elements that face the rolling surfaces of the guide rail, wherein the running rail is implemented as a profile rail which has, on a bottom side, an elongated opening and encompasses the intermediate rail, whereby two supporting rollers are supported on the front end of the intermediate rail on axles that protrude horizontally from opposing lateral profile legs of the intermediate rail perpendicular to a pull-out direction, with peripheral surfaces of the supporting rollers being supported on rolling surfaces arranged on an interior of the running rail and extending in the pull-out direction, wherein the axles which rotatably support the supporting rollers are provided on a separate axle support that can be attached to the front end of the intermediate rail, wherein the axle support has the form of a retaining member which fittingly encompasses the outer sides of the intermediate rail and which is open on the bottom side, wherein the retaining member has a cross-sectional shape which resembles a "U" rotated by 180° and which is open on the bottom side, wherein the downward pointing lateral U-shaped legs of the retaining member can be brought into suitable contact with the lateral profile legs of the intermediate rail, and further wherein latchingly engageable projections and openings are provided in the regions of the U-shaped legs of the retaining member and the lateral profile legs that face one another in the intended installation position of the axle support on the intermediate rail.

2. Drawer guide according to claim 1, wherein the projections protrude from the inner sides of the U-shaped leg of the retaining member and engage in the openings which are formed as punched-out sections in the profile legs of the intermediate rail.

3. Drawer guide according to claim 2, wherein the projections are provided with beveled stop sections which facilitate installation of the retaining member attached on the intermediate rail from the web surface.

4. Drawer guide according to claim 1, wherein a web section of the retaining member connecting the U-shaped legs is formed so as to be elastically deformable in a center region extending in the pull-out direction.

* * * * *